United States Patent [19]

Davison et al.

[11] Patent Number: 4,883,147

[45] Date of Patent: Nov. 28, 1989

[54] SCAFFOLDING SYSTEMS AND CLAMPING DEVICES THEREFOR

[75] Inventors: Derek G. Davison; Gordon T. Pover, both of Kent, England

[73] Assignee: Derek George Davison, Kent, England

[21] Appl. No.: 211,921

[22] Filed: Jun. 27, 1988

[30] Foreign Application Priority Data

Jun. 25, 1987 [GB] United Kingdom ..... 8714945

[51] Int. Cl.[4] ..... E04G 1/14; E04G 7/06

[52] U.S. Cl. ..... 182/179; 182/152

[58] Field of Search ..... 24/205.13 R, 14 R, 14 K, 24/19, 274 R; 182/179, 178, 152

[56] References Cited

U.S. PATENT DOCUMENTS 2,994,402 8/1961 Tyler ..... 182/152

4,534,448 8/1985 Trainer ..... 182/222

FOREIGN PATENT DOCUMENTS 2533610 9/1982 France ..... 182/152

*Primary Examiner*—Reinaldo P. Machado

*Attorney, Agent, or Firm*—Wenderoth, Lind & Ponack

[57] ABSTRACT

A form of scaffolding construction is described in which rectangular frame units extend between and are screwed to vertical scaffloding tubes. Clamping devices for this purpose comprise a rigid angle element having a short arm and a longer arm, a short element hinged to the longer arm, a longer element hinged to the short element and having at its free end means whereby it can be releasably interlocked to the shorter arm of the angle element. The tubes are disposed side by side within the device and are separated by a dividing element connected to the longer arm. A clamping screw extending through the short element is tightened to interlock the longer element to the shorter arm of the angle element about the two tubes.

4 Claims, 3 Drawing Sheets

SCAFFOLDING SYSTEMS AND CLAMPING DEVICES THEREFOR

This invention relates to scaffolding systems and clamping devices therefor.

According to this invention, there is provided a scaffolding system comprising vertical members, a plurality of one-piece rectangular frames each disposed with two of its sides disposed adjacent and, parallel to respective vertical members, and individual clamping elements adapted to secure said sides releasably to said vertical members.

The invention also provides a clamping device for securing two scaffolding tubes together in side-by-side relationship comprising an angle element one arm of which is generally twice as long as the other, a second element which is hinged by one of its ends to the free end of said one arm and which is substantially equal in length to said other arm, a third element which is substantially equal in length to said one arm and which has one end thereof hingedly connected to the other end of said second element, interlocking means between the other end of said third element, and the free end of said other arm which interlocking means is engageable by movement of the third element lengthwise of itself, a dividing element connected to said one arm at substantially its mid-length and extending generally parallel to said other arm and clamping means whereby when two scaffolding tubes are disposed on opposite sides respectively of the dividing element and are enclosed in the device by engagement of the interlocking means, the two tubes can be releasably clamped in position.

In one preferred construction according to the invention the dividing element is capable of limited movement towards and away from said other arm and the clamping means comprises a screw member mounted in either said other arm or said second element and is operable to clamp the two tubes against said second element or, as the case may be said other arm, through the dividing element.

According to a preferred feature of the invention a spring clip is provided for resiliently retaining a scaffolding tube in the angle of the angle element.

Figure 1:
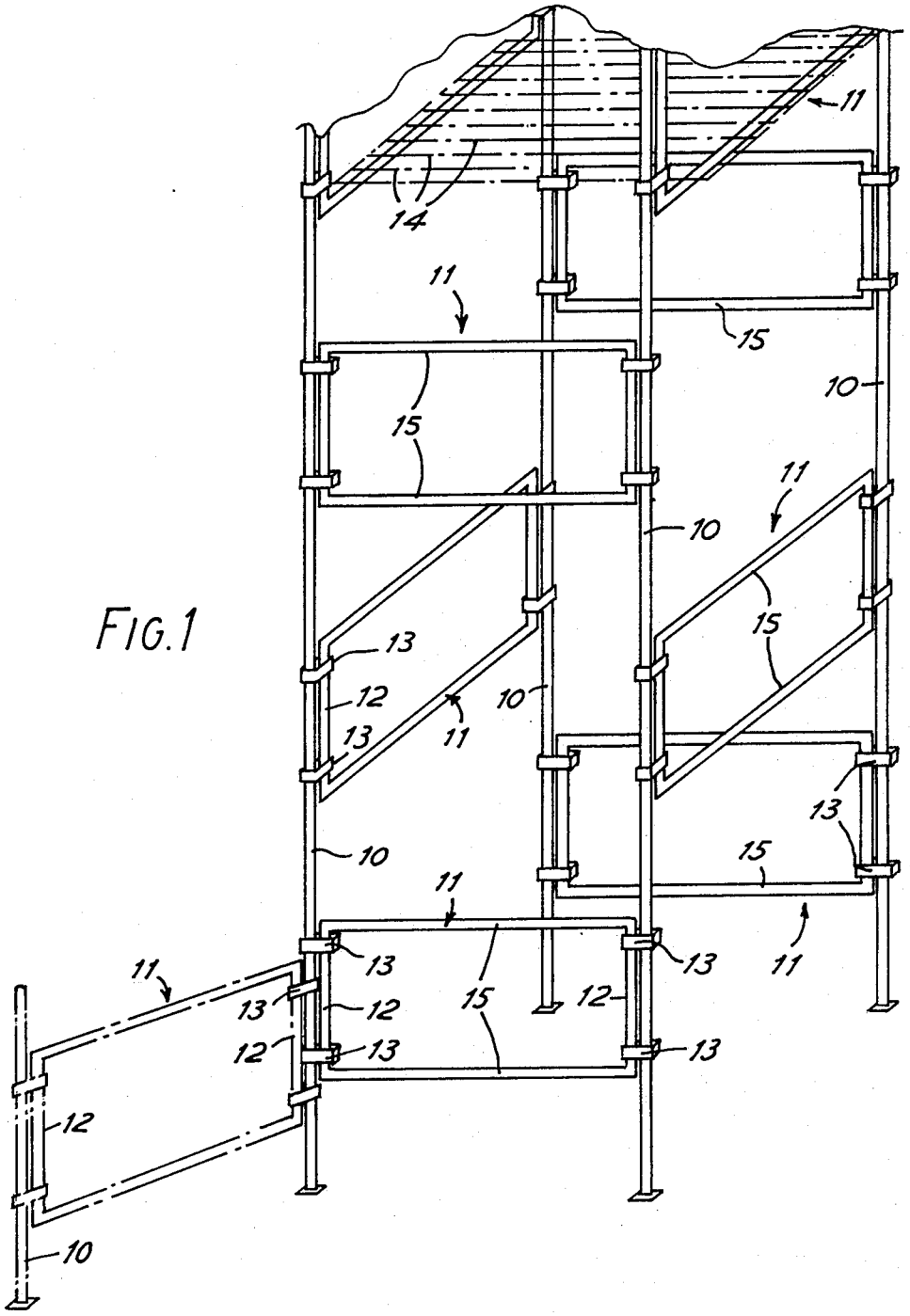
Figure 2:
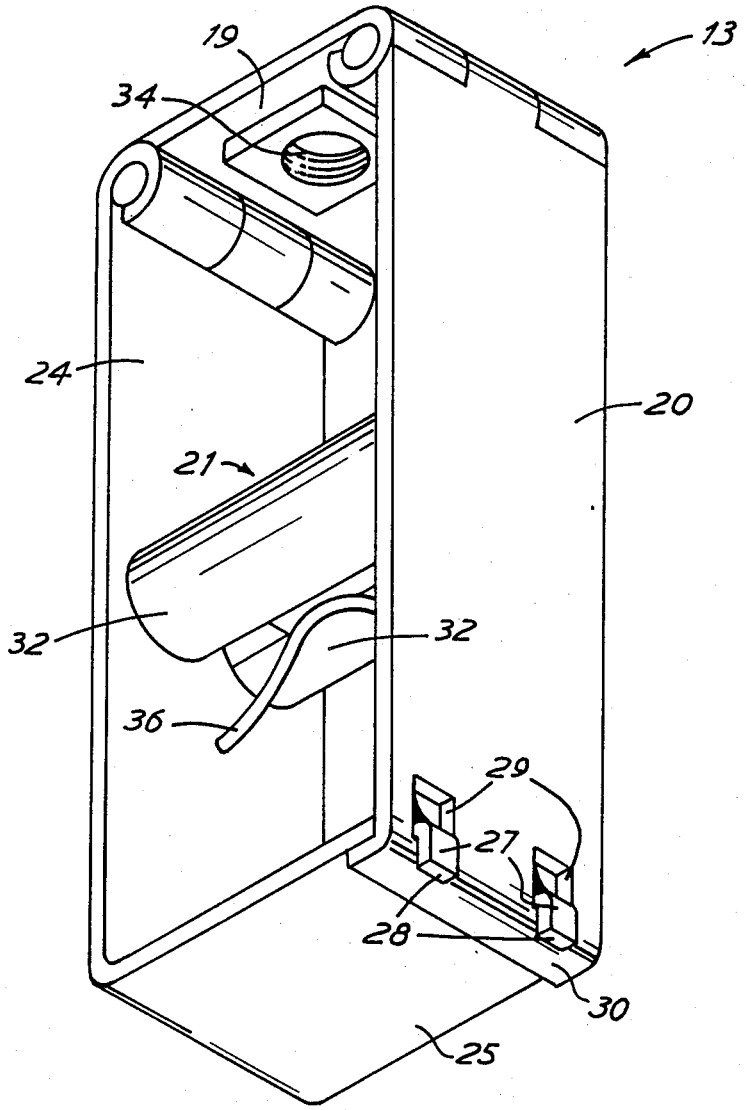
Figure 3:
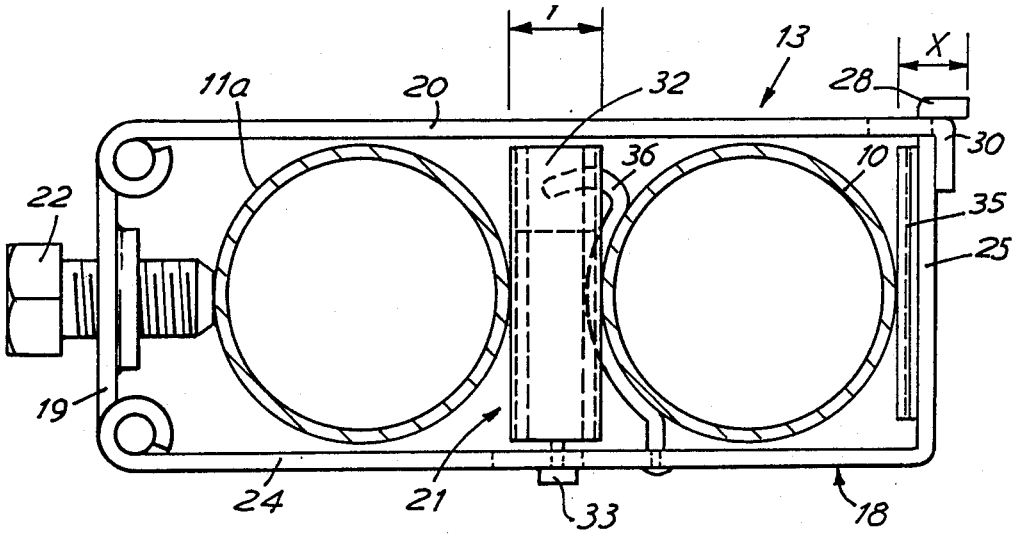
Figure 4:
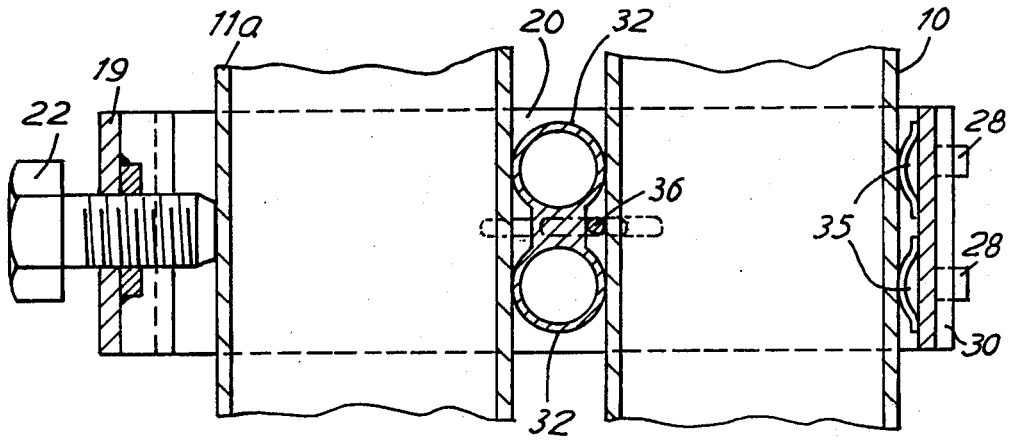

The invention will now be described in more detail with reference to the accompanying diagrammatic drawings in which;

FIG. 1 illustrates a scaffolding system according to the invention, employed to provide a tower, FIG. 2 is a perspective view of a clamping device used in the scaffolding system, FIG. 3 is a plan view of the device of FIG. 2, FIG. 4 is a sectional view on the plane 4—4 of FIG. 3.

Referring first to FIG. 1 one embodiment of a scaffolding system according to the invention is shown. In this instance the scaffolding forms a tower. Four vertical scaffolding tubes 10 define the corners of the tower and each adjacent pair of tubes 10 are interconnected by a number of unitary rectangular frames 11 each formed from lengths of scaffolding tube welded together. The vertical elements 12 of each frame are connected to the scaffolding tubes 10 by two individual clamping devices 13 spaced apart lengthwise of the tubes 10. The frames 11 can be positioned at any convenient heights and scaffolding planks 14 can be supported on the horizontal elements 15 of the frames. If required, one or more bracing frames may be added to the tower by securing diagonally outwardly extending frames 11 to the tubes 10 and to short outer vertical scaffolding tubes **10*a*** as shown in chain lines.

It will be clear that since the clamping devices 13 are separate from the tubes 10 and the frames 11, the tubes can be disposed at different levels without affecting the stability of the tower, for example on a sloping or uneven site.

If desired the tubes 10 can be arranged in a line, and interconnected by frames 11 the tubes 10 being anchored by putlogs to form so-called bricklayers scaffolding. Alternatively the tubes 10 may be disposed in two parallel lines and interconnected by frames 11 extending parallel to and at right angles to the lines to form independent or free-standing scaffolding.

The frames are preferably of varying lengths and heights so that work can be carried out most conveniently at any desired height.

The system is thus sufficiently flexible to be used instead of or in conjunction with conventional scaffolding, but in its application to towers is greatly superior to known tower systems since the components of the latter are expensive and cumbersome and cannot be erected on uneven ground without the use of jacking devices or packing, because the vertical corner components of the tower sections are rigidly and permanently connected in the horizontal components.

The clamping devices used in the present scaffolding system will now be described particularly in relation to FIGS. 2 to 4. Each device comprises an angle element 18, hinged elements 19 and 20 all of which are made from strong rigid strip material, a dividing element 21 and a clamping setscrew 22. The angle element 18 has two arms 24, 25, of which arm 24 is substantially twice as long as arm 25. Element 19 is hinged to the free end of arm 24 and has element 20 hinged to its other end. The lengths of elements 19 and 20 are substantially equal to those of the arms 25 and 24 respectively. The free edge of arm 25 is formed with two tongues 27 the end parts 28 of which extend outward at right angles to the arm 25, and these tongues project through respective slots 29 extending lengthwise of the element 20 near its free end, the free end part 30 of element 20 being bent to be engageable with the outer surface of arm 25.

The dividing element 21 comprises, in this construction, two tubular parts 32 welded together and to a pin 33 disposed between them, one end of the pin projecting through a hole in the arm 24 and being riveted over. The hole is larger in diameter than the pin so that the dividing element 21 can rotate and rock from side to side to a limited extent.

The hinged element 19 has a central threaded hole 34 in which the setscrew 22 is engaged.

To secure say an upright tube **11*a* of a frame 11 to a scaffolding tube 10 together the clamping device 13 is first opened by disengaging the tongues 27 from the slots 29 in element 20 to enable this element and element 19 to be swung into an open position. The dividing element 21 is then passed between the tubes and the elements are returned to their former positions the tongues 27 being passed through the slots 29. It may be necessary partly to unscrew the setscrew 22 to enable this to be done. The setscrew is then tightened against the adjacent tube 10 which causes the tongues 27 to be moved towards the outer ends of their slots 29, the free end part of element 30 to be pulled against the outer face of arm 25, and simultaneously presses the tubes 10 and 11*a* and dividing element 21 laterally until the two tubes are clamped via the dividing element, between the setscrew 22 and the inner surface of arm 25. The said inner surface of arm 25 may be formed with ridges 35** as shown to improve its grip upon the tube.

A gap is left between the two tubular parts 32 of the dividing element 21 at its free end and accommodates the free end of a spring wire clip 36 welded at its other end in a hole in arm 24. The spring extends in an arc similar in radius to the tube 10 and is arranged so that the act of pressing a tube between the dividing element 21 and arm 25 causes the clip 36 to be deflected and then to spring back to retain the tube resiliently. The spring clip 36 enables the device to remain static in its position on tube 10 to allow frame 11 to be positioned and adjusted for height and alignment.

A particular advantage of the illustrated clamping device is that it is possible to manoeuvre the device between two tubes which are already secured together by a similar device, in order to secure a third tube to one of the two so that three tubes can be secured in parallel, as is necessary where for example vertical members of two rectangular frames arranged level with each other are to be secured to a single vertical scaffold tube. For this purpose, the arm 25 of the second clamp must be capable of being passed through the gap between the scaffolding tube 10 and the vertical tube 11*a* of the first frame, and in consequence the overall "thickness" X of arm 25 must be made less than the corresponding dimension Y of the dividing element 21, since the presence of the set screw 22 prevents hinged element 19 of the second clamp from occupying a position between tubes 10 and 11*a*.

What is claimed is:

1. A scaffolding system comprising vertical members, a plurality of rectangular frame units each having vertical side elements and horizontal top and bottom elements joining the side elements, each of which side elements is disposed adjacent and parallel to respective vertical members, and individual clamping devices securing the side elements of the frame units to said respective vertical members, each clamping device comprising an angle element one arm of which is generally twice as long as the other, a second element which is hinged by one of its ends to the free end of said one arm and which is substantially equal in length to said other arm, a third element which is substantially equal in length to said one arm and which has one end thereof hingedly connected to the other end of said second element, interlocking means between the other end of said third element, and the free end of said other arm which interlocking means is engageable by movement of the third element lengthwise of itself, a dividing element connected to said one arm at substantially its mid-length and extending generally parallel to said other arm and clamping means, a vertical side element and a vertical members being disposed on opposite sides of the dividing element and enclosed in the device by engagement of the interlocking means.

2. A clamping device for securing two scaffolding tubes together in side-by-side relationship comprising an angle element one arm of which is generally twice as long as the other, a second element which is hinged by one of its ends to the free end of said one arm and which is substantially equal in length to said other arm, a third element which is substantially equal in length to said one arm and which has one end thereof hingedly connected to the other end of said second element, interlocing means between the other end of said third element, and the free end of said other arm which interlocking means is engageably byy movement of the third element lengthwise of itself, a dividing element connected to said one arm at substantially its mid-length and extending generally parallel to said other arm and clamping means whereby when two scaffolding tubes are disposed on opposite sides respectively of the dividing element and are enclosed in the device by engagement of the interlocking means, the two tubes can be releasably clamped in position.

3. A clamping device as claimed in claim 2, wherein the dividing element is capable of limited movement towards and away from said other arm and the clamping means comprises a screw member mounted in either said other arm or said second element and is operable to clamp the two tubes against said second element or, as the case may be said other arm, through the dividing element.

4. A clamping device as claimed in claim 2, wherein a spring clip is provided for resiliently retaining a scaffolding tube in the angle of the angle element.

* * * * *